United States Patent [19]

Reuter et al.

[11] 3,958,620

[45] May 25, 1976

[54] METHOD FOR PRODUCING BLANK METAL INGOTS OF UNIFORM CROSS SECTION AND IN PARTICULAR STEEL INGOTS

[75] Inventors: Guido Reuter, Dusseldorf; Hans Robertz, Monchengladbach, both of Germany

[73] Assignee: Rheinstahl Giesserei A.G., Germany

[22] Filed: Aug. 9, 1974

[21] Appl. No.: 496,296

Related U.S. Application Data

[63] Continuation of Ser. No. 179,007, Sept. 9, 1971, abandoned.

[30] Foreign Application Priority Data

July 16, 1970 Germany ..... 2035251

[52] U.S. Cl. ..... 164/133; 249/174

[51] Int. Cl.[2] ..... B22D 7/00

[58] Field of Search ..... 164/120, 133, 306, 119, 164/309, 316–318; 249/174

[56] References Cited

UNITED STATES PATENTS

| | | | |
|---|---|---|---|
| 390,809 | 10/1888 | Singer | 164/120 |
| 1,583,248 | 5/1926 | Durville | 164/133 |
| 2,937,424 | 5/1960 | Guenzi | 22/139 |
| 3,191,292 | 6/1965 | Strom | 164/133 X |
| 3,274,681 | 9/1966 | Lohman | 29/528 |

FOREIGN PATENTS OR APPLICATIONS

| | | | |
|---|---|---|---|
| 717,450 | 2/1942 | Germany | 164/363 |
| 13,593 | 7/1909 | United Kingdom | 164/306 |
| 937,236 | 9/1963 | United Kingdom | |

*Primary Examiner*—Ronald J. Shore
*Assistant Examiner*—Gus T. Hampilos
*Attorney, Agent, or Firm*—McGlew and Tuttle

[57] ABSTRACT

Blank metal ingots particularly steel of uniform weight per piece and cross section are formed with a mold which is made up of a plurality of superposed vertical sections which together define an interior mold cavity of uniform cross section over its total height. The steel which is produced in a known steel making method is first tapped into a casting ladle which is provided with a refractory lining. A plurality of mold sections are built up one after the other over a casting plate and the steel is directed upwardly through a bottom opening on the plate into the mold cavity and as soon as the mold is completely filled the slide plate is closed. For casting ingots of round or polygonal cross section with diameters of 200 to 350 millimeters the steel is bottom poured into the mold cavity at a rate of rise of from 30 to 80 centimeters per minute and the surface of the melt is not covered but is maintained as cold as possible. The inflow to the mold cavity is exactly centered and for ingots of diameters of larger than 300 millimeters the mold is covered with a heat insulating powder and the rate of rise is maintained between 10 to 30 centimeters per minute. A mold is constructed of carbon-rich iron and in particular a hematite whose inner cross section is constant over its total length and which is divided in axial direction into several sections, with the total length of the mold being greater than 2 meters and having a clearance less than 250 millimeters. The mold is characterized by the fact that its weight is at least 1.3 times the weight of the ingot which is formed.

2 Claims, 3 Drawing Figures

INVENTORS
GUIDO REUTER
HANS ROBERTZ
BY
John J. McGlew
ATTORNEY

INVENTORS
GUIDO REUTER
HANS ROBERTZ
BY
John J. Meblen
ATTORNEY

INVENTORS
GUIDO REUTER
HANS ROBERTZ
BY John J. McGlew
ATTORNEY

METHOD FOR PRODUCING BLANK METAL INGOTS OF UNIFORM CROSS SECTION AND IN PARTICULAR STEEL INGOTS

This is a continuation of application Ser. No. 179,007 filed Sept. 9, 1971, now abandoned.

BACKGROUND OF THE INVENTION

1. Field of the Invention

This invention relates in general to a new and useful method and apparatus for producing blank material of uniform weight per piece and cross-section of a metal particularly a steel and wherein the ingot is produced by bottom pouring into a vertically elongated mold at a relatively slow rate.

2. Description of the Prior Art

The fabrication of many rotation-symmetrical parts on shaping machines is in part semi-automated or fully automated and therefore requires starting material of uniform weight per piece and of uniform cross-section, as for example: rings, railroad wheels, car tires, containers, tubes, etc. It is known practice to produce such blank material by casting the steel in conical molds, rolling out or forging out the resulting conical ingot to obtain a uniform cross section having a good surface quality, and subsequently dividing the shaped ingot into sections of equal length. This known method does indeed furnish satisfactory blank material, which because of the uniform cross section can well be processed further and can easily be divided into blank material of equal weight by division into sections of equal length. However, it is a disadvantage that the cast ingot must be subjected to an additional shaping operation.

It is further known to cast conical long ingots and to use these ingots without further shaping after their division into sections of equal weight for further processing in ring rolling mills. The disadvantage of this method is that because of the different cross-sections required, the sections must be cut in unequal lengths and it is difficult to maintain the required uniformity of weight. Moreover, use in semi-automatic or fully automatic systems often precludes a variable cross-section of the blank material. It is further known to cast individual ingots and to use them for ring production without further division or shaping. This method is generally uneconomical, as the expense in casting, cleaning (polishing) and transportation is higher and the yield less favorable than for the long ingot (Stahl and Eisen 79 (1959) p. 1913 ff).

Taking this state of the art as point of departure, the problem of the invention is seen in the fact that for the part, full or semi-automatic further processing, such as rolling in a ring rolling mill or fabrication of tubes or containers on a shaping machine, it is important that the blank material should, at equal length, have equal weight and also equal cross-section of each individual section size, and it is difficult to produce these, without rolling or forging deformation, in a quality insuring their destruction-free processing.

The known molds are generally designed conical to facilitate the stripping of the solidified ingots. There has also been produced a heavy ingot form of a weight of 114 t and a length of 5.20 m with equal cross section over the entire length, as it was expected that, due to their great diameter the ingots to be cast, would shrink sufficiently so that they could be pulled out of the iron mold even without taper (Stahl and Eisen (1922, p. 653). Nothing has been reported about the behavior of this mold in casting. It is stated in "Stahl und Eisen" 1931, on page 1225, left column, that for the downwardly widening mold as little conicity as possible is desirable. A conicity of 1.3 and down to 0.7 is regarded as sufficient to avoid difficulties in stripping. Experiments with parallel walled molds are also being carried out. Besides, for molds of equal cross section over their entire length the removal of the cast ingot is made possible by longitudinal division of the molds (e.g. German Pat. Nos. 95,515, 67,035). While such longitudinally divided molds facilitate the removal of the ingots, they may easily lead to elevations on the ingot (burrs) at the points of division by inflow of the liquid metal during pouring. Due to this defect, the material cast in longitudinally divided molds is usable as blank material for further processing only with qualifications or only after considerable polishing (cleaning), since at these points it may easily lead to bursting or overrolling during upsetting, stretching and rolling in axial direction. Further, divided molds, in particular in the case of long ingots, are unfavorable because of the susceptibility of warping with the difficulty of sealing the point of division during casting. The high cracking susceptibility in conventionally poured ingots of circular cross-section as against those with polygonal cross section or corrugated surface, and the difficulties in stripping to be expected for ingots of equal cross-section over their length, have until now led to the result that no ingots are poured with equal cross-section over the length, in particular with round cross section.

SUMMARY OF THE INVENTION

In a process for the production of blank material of uniform weight per piece and uniform cross-section from steel, in particular for ring or tube rolling mills, this problem is solved according to the invention in that the blank material is produced by casting ingots with constant cross section over their entire length, and avoiding ruts or elevations over the circumference that would impair their usefulness. This is done in upright molds and by dividing the ingots into sections of equal length.

Further, the invention can be advantageously devised as follows:

For the casting of ingots of round or polygonal cross-section with diameters of 200 to 350mm, the invention recommends bottom-pouring of the mold at rates of rise of 30 to 80cm per minute and with the surface of the melt in the mold not covered, as cold as possible. Attention should be paid to insure that the inflow into the mold is exactly centered. For ingots of larger diameters of more than 300 mm, the surface of the melt in the mold is covered with a heat-insulating powder and is cast centrally as cold as possible and at rates of rise between 10 and 30 cm/min. By the fairly slow pouring one obtains a uniform solidification from foot to head of the ingot with much smaller differences in concentration due to segregation (or liquation) between foot and head of the ingots than in the known conical ingots. Moreover, the slot pouring permits the use of a smaller hood for the tight feeding of the ingot and improves the yield.

In a method for the production of blank material where the melt is transported into the upright mold from below by application of gas pressure onto its surface, one achieves a rapid filling of the mold with the possibility of cold pouring, leading to a uniform solidification with little segregation.

For the practice of the method the invention the mold should be of carbon-rich iron, in particular hematite, whose inside cross-section is equal over its total length and one which is undivided or not parted, in axial direction and whose length is greater than 2 m, and whose clearance (inside diameter of the mold) is greater than 250 mm. The mold is distinguished by the fact that its weight is at least 1.3 times the ingot weight. The mold weight is dependent on the ingot diameter, the mold weight to ingot weight ratio increasing with decreasing diameter to above 3.

Experiments made by the Applicant have shown that with molds undivided in axial direction, with equal cross section over their total length, crack-free ingots can be poured which can be stripped without difficulty even without machining of the inner mold surfaces if the mold weight is at least 1.3 times the ingot weight. A smaller ratio of the mold weight to the ingot weight, i.e. a smaller mold wall thickness, resulted in cracking and, due to warping, in difficulties in stripping. Observance of the above-mentioned casting conditions proved advantageous.

The effect of the mold weight on the formation of cracks was not to be expected for the following reason: crack formations are mainly affected by the cooling conditions. The weight of the mold affects the cooling conditions, but at so late a time that there is little likelihood of an effect on the crack formation. According to calculations of the time-response of the temperature penetration curves in molds, which in their qualitative response were confirmed by experimental studies (Stahl u. Eisen 1943, p. 204), a temperature of approximately 1000°C occurs immediately after the charging of liquid steel in a hematite mold at the inner wall thereof. When pouring, for example, a 5-ton ingot into a square mold of equal weight having a wall thickness of approximately 12 cm, the heat, if the inner wall of the mold is maintained constant at 1000°C, would penetrate to the outside in approximately 6 minutes and would there raise the temperature by approximately 70°C. If the mold weight is increased to one and a half times the ingot weight — this would correspond to a mold wall thickness of 17 cm — the outer wall temperature of the mold would not yet be increased in the 6 minute time as mentioned above. However at a distance of 12 cm from the inner mold wall, the temperature would also in this case be approximately 70°C after 6 minutes. The temperature gradient on the inner wall of the mold determines the quantity of heat per unit prime that can be transported from the surface of the solidifying ingot into the mold. There has, therefore, been no change due to increase of the weight of the mold. It must be assumed, therefore, that 6 minutes after start of solidification of the cast ingot the same conditions must prevail in the mold having a weight equal to the ingot weight as in a mold having one and a half times the ingot weight. At that time, however, according to the rough formula $D = 2.5 \times k \times \sqrt{t}$ — with D = solidified thickness in cm, $k$ between 0.9 and 1.22, and $t$ time in min. — (Basic Open Hearth Steelmaking, 1964, p.437), approximately 6 cm of steel are already solidified. Considering further that by the formation of the air gap due to the detachment of the ingot as it shrinks the heat transfer becomes more difficult after around 1 minute, and that even at later times, when the mold wall has already appreciably gained in temperature, the effect on the gradient at the inner mold wall is extremely slight, it is hard to see how the mold weight should influence the heat removal from the ingot at a time when the solidified layer is still so thin that, for example due to internal pressure, it could still be susceptible to cracking. The Applicantd's experiments have shown that despite these theoretical doubts it has been possible, by the increase as per invention of the mold weight over what has been known at equal cross section the entire length, to produce perfectly crack-free ingots which can be stripped without difficulties and be divided into sections of equal length having uniform weights per piece and which, without prior shaping, withstand an upsetting deformation without waste.

Of particular advantage is a construction with the inner cross-section of the mold of circular shape. Ingots of circular cross-section are particularly well suited as blank material for ring rolling mills, tube rolling mills, shaping machines, forging machines, extrusion presses, or also for further forging deformation as shafts and axles. Even in the round ingot material, which in itself is particularly susceptible of cracking, no disturbances due to cracks occur.

To reduce the mold costs, the mold may be subdivided in transverse direction into a number of sections. The bottom section which due to the inflow of liquid steel is subject to particularly heavy stress during casting and therefore has a shorter life than the upper sections, is advantageously the shortest. The subdivision of the mold into sections permits moreover the pouring of ingots of different lengths by simply placing the sections one upon the other, without the necessity of keeping in stock a number of special molds corresponding to the various lengths of ingots.

For the practice of the method, especially for long ingots, there is particularly suitable a casting machine for the pressure casting method which comprises a refractory-lined vessel with a removable cover placed on pressure-tight and with a locking device. A refractory-lined casting tube extends from the bottom of the vessel upwardly at least to a casting plate contiguous to the casting tube. A mold of carbon-rich iron, undivided in axial direction is placed closely adjacent to the casting plate, and has a constant cross-section over its total height. The casting machine permits a very rapid, exactly proportioned and yet gentle filling of the mold with a relatively cold casting, and complete avoidance of air oxidation during casting, owing to which the solidification conditions are favorable and homogeneous ingots of highest surface quality can be produced.

The ingots with uniform cross section produced by the method of the invention are, however, advantageously applicable not only when blank material of uniform weights per piece is needed. Also in the case of blank material with different weights per piece, for example, for rings of different sizes, it is possible, because of the equal cross-section over the total length, to adjust the given individual weight per piece quickly and accurately by way of a simple length measurement. Moreover, the advantages as to structure of the ingots cast according to the invention are beneficial in further processing also at different weights per piece.

Accordingly it is an object of the invention to provide an improved method for producing a blank material of uniform cross section of a metal such as steel and using a vertically elongated upright mold comprising directing the steel into a casting ladle and applying a pressure to the steel to cause it to rise upwardly through a bottom opening of the mold, and by bottom-pouring at a relatively slow rate.

A further object of the invention is to provide a method of producing blank material using a mold having a round or polygonal cross-section with inside diameters of 250 to 350 mm and by pouring at rates of rise from 30 to 80 cm. per minute with an uncovered surface of the melt and centering the inflow and maintaining the melt as cold as possible.

A further object of the invention is to provide a device for forming metal billets which comprises a mold having a cavity which is vertically elongated and of uniform diameter and is made up of a plurality of sections which are interfitted one over the other and which are arranged over a casting plate having an opening therein with a slide valve.

A further object of the invention is to provide a device for forming blank material of uniform cross section which is simple in deisgn, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference should be had to the accompanying drawing and descriptive matter in which there is illustrated preferred embodiments of the invention.

GENERAL DESCRIPTION OF THE PREFERRED EMBODIMENT

Figure 1:
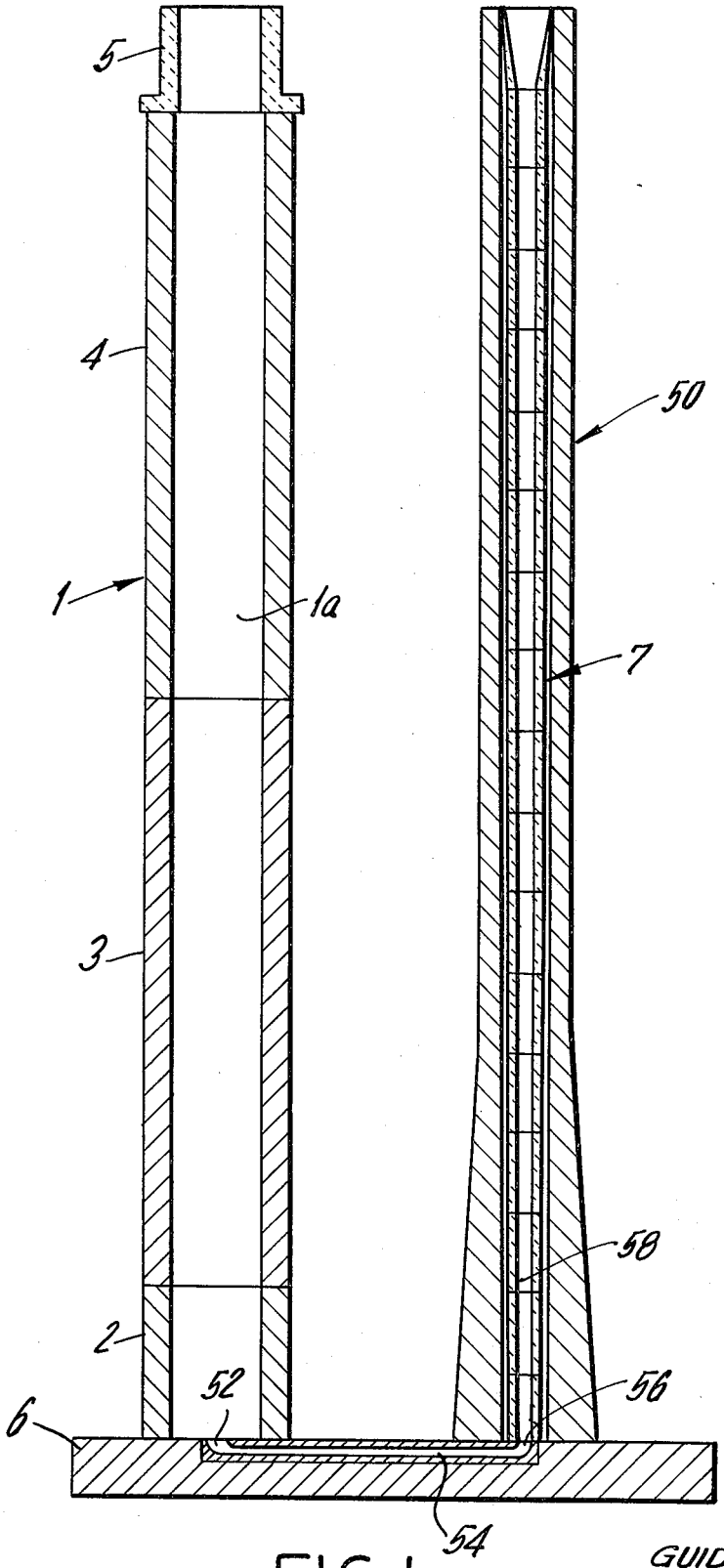
FIG. 1 is a transverse sectional view of a mold constructed in accordance with the invention.

Referring to the drawings in particular, the invention embodied therein in FIG. 1 comprises a casting apparatus generally designated 50 which includes a casting mold generally designated 1 which is made of a material such as iron. It is formed of a plurality of sections 2, 3 and 4 with the lowermost section 2 being the shortest in height. The mold defines a mold cavity 1*a* having an interior cross-section which is the same over its entire height. Its total height is 7 meters and its inner diameter or clearance is 377 mm., and its wall thickness averages about 165 mm. The ingot to be cast has a weight of about 6 tons. The mold weight is 1.84 times the ingot weight.

A feature of the construction is that the individual sections 2, 3 and 4 may be arranged one over the other and without sealing the joints therebetween by centering the individual sections on interfitting grooves and spring rings (not shown) which are built into each mold section. A mold hat top 5 of refractory material serves to fill up the shrink hole upon solidification of the ingot. The mold may be built up easily over a pouring opening 52 at the end of a pouring passageway 54 of the casting plate 6. An opposite opening 56 is located to align with the bottom end of a refractory line passage 58 of a casting funnel 7.

An example for the production of a blank material of uniform weight per piece and cross section for a ring rolling mill using the bottom casting method of the invention is as follows:

| Example 1 | Grade 46 Cr 2 |
|---|---|
| Casting temperature: 1,585° + 5°C | |
| Mold diameter inside, mm | Rate of rise cm/min |
| 250 $\phi$ | 36 |
| 200 $\phi$ | 38.5 |
| 370 $\phi$ | 17 |
| 500 $\phi$ | 14 |
| 600 $\phi$ | 11.9 |
| **Example 2** | **Grade × 20 Cr 13** |
| Casting temperature: 1,550°C ±5°C | |
| Mold diameter inside, mm | Rate of rise cm/min |
| 250 $\phi$ | 55 |
| 300 $\phi$ | 58 |
| 330 $\phi$ | 65 |

The symbol $\phi$ in Examples 1 and 2 means "diameter"; "Grade" indicates quality of steel: According to the German material standards Stahl und Eisen (steel and iron), list of steels No. 17006, the steel 46 Cr 2 has the following composition: C 0.42 to 0.50 percent, Si0.15 to 0.40, Mn 0.50 to 0.80, P max. 0.035 percent, S max. 0.035 percent, Cr 0.40 to 0.60 percent; and according to the steel-iron list No. 14021, the steel x 20 Cr 13 has the following composition: C 0.17 to 0.22 percent, Si max. 1.0 percent, Mn max. 1.0 percent, P. max 0.045 percent, S max. 0.030 percent, Cr 12.0 to 12.0 percent.

The ingots of sizes 250 mm, 300 mm, and 330 mm round were cast without covering the liquid level in the mold. The mold itself was coated with a bitumen based mold lacquer. Ingots with a larger diameter were cast with a covering of heat insulating powder. In view of the great length of the mold or height of the mold relative to its diameter the yield is particularly high because of the small proportion of the head and foot weight. This long mold can be used with the same advantages in group casting as well as in casting machines.

Figure 2:
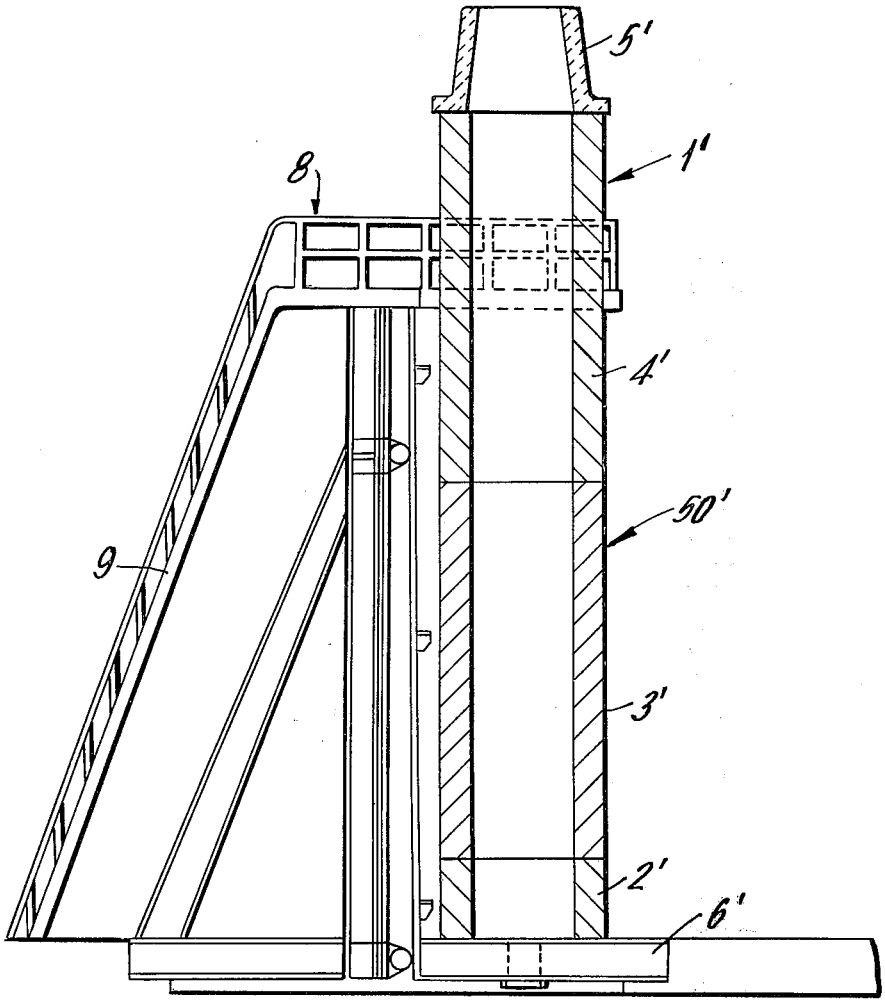
FIG. 2 is a view similar to FIG. 1 of another embodiment of the invention.

In the embodiment shown in FIG. 2, there is provided casting equipment generally designated 50′ in which a casting plate 6′ is arranged at the bottom of a frame structure 8 which includes a top platform accessible by a stairway 9. The platform and the stairway facilitate the working on the mold, as for example, when it is lacquered. The other parts are similar to the embodiments shown in FIG. 1.

Figure 3:
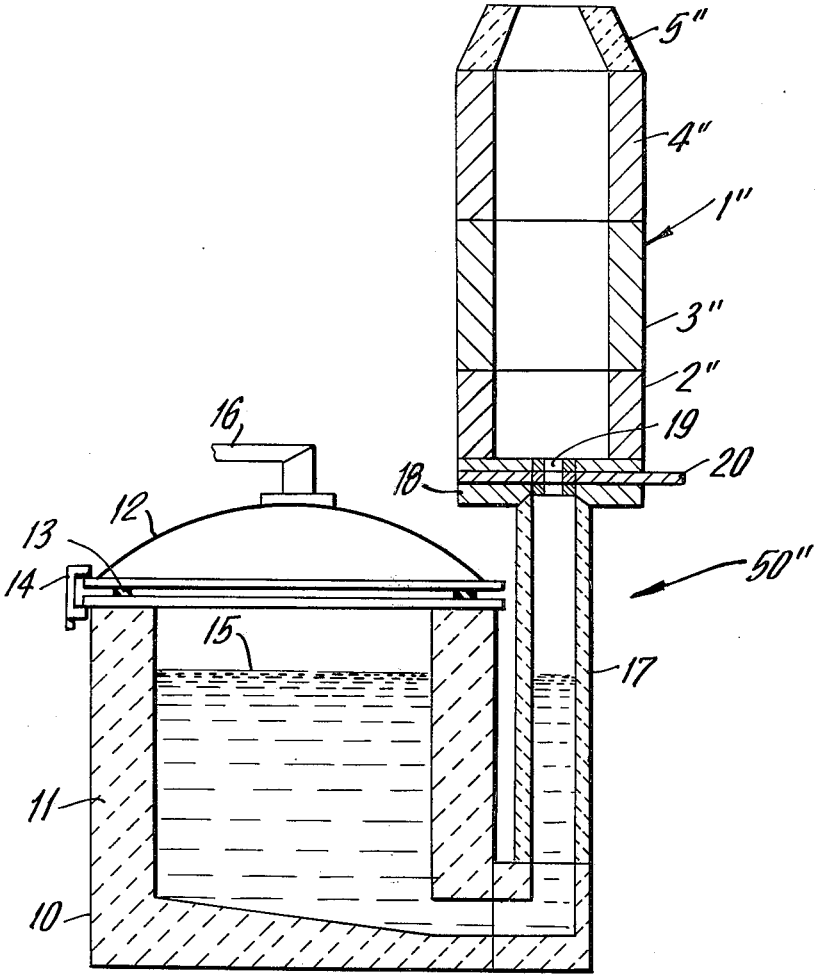
FIG. 3 is a view similar to FIG. 1 of still another embodiment of the invention.

In FIG. 3 there is shown a casting apparatus generally designated 50″ which includes a casting plate 18 having a bottom opening 19 for the inpouring of the metal which may be closed by a slide plate 20 after the mold, generally designated 1″ has been filled. The mold 1″ is made of a plurality of vertically stacked sections as in the other embodiment.

With the casting machine constructed in accordance with FIG. 3, the ingots are cast in accordance with the method of the invention as follows: The steel produced in a known steel making method is tapped into a casting ladle having a plug. By opening the plug the steel flows without slag into the vessel 10 which is provided with a refractory lining 11. After the vessel 10 is filled it is closed with a cover 12. By means of packing 13 and locking device 14 the cover is connected air tight over the vessel 10.

By the application of compressed air onto the melt level 15 through compressed air line 16, the steel is forced through the refractory lined casting tube 17 and through the opening 19 of the casting plate 18 into the cavity of the mold 1''. As soon as the mold cavity is filled the slide valve 20 and the casting plate 18 is closed so that the steel is prevented from flowing backwardly. By evacuation of the vessel 10 the steel contained in the casting tube flows backwardly. The mold 1'' is then removed with the casting plate 18 and is replaced by a new mold and new casting plate which can be filled by the same procedure.

While specific embodiments of the invention have been shown and described in detail to illustrate the application of the principles of the invention, it will be understood that the invention may be embodied otherwise without departing from such principles.

What is claimed is:

1. A method of casting steel ingots with no taper and no draft, having a length in excess of 2 meters, a minimum diameter of 250 mm, and a uniform cross-section throughout the length thereof, comprising the steps of providing an undivided vertically elongated upright mold of iron having a length of at least 2 meters with an inner cross-section which is uniform throughout the length of the mold which mold has a weight of at least 1.3 times the ingot weight, supplying molten steel into the mold at the center of the bottom end thereof, to flow upwardly through the mold, while maintaining the temperature of the steel at as low a pouring temperature as possible, and maintaining a rate of rise of the steel in the mold, of from 10 to 80 cm/minute to form the ingot, and subsequently dividing the ingot into sections having equal lengths and weights.

2. A method according to claim 1, wherein said mold is made of a carbon-rich iron.

* * * * *